United States Patent [19]

Otfried et al.

[11] Patent Number: 4,790,244

[45] Date of Patent: Dec. 13, 1988

[54] SUCTION SYSTEM FOR SHEET GUIDING CYLINDERS IN PRINTING MACHINES

[75] Inventors: Rudolph Otfried, Dresden; Peter Gunter, Radebeul, both of German Democratic Rep.

[73] Assignee: Kombinat Polygraph "Werner Lamberz" Leipzig, Leipzig, German Democratic Rep.

[21] Appl. No.: 24,377

[22] Filed: Mar. 10, 1987

[30] Foreign Application Priority Data

Apr. 21, 1986 [DD] German Democratic Rep. ..... 2893991

[51] Int. Cl.[4] ..... B41F 21/06

[52] U.S. Cl. ..... 101/231; 101/232; 101/410; 271/276; 271/196; 271/277

[58] Field of Search ..... 101/231, 232, 409, 410; 271/276, 277, 108, 231, 196

[56] References Cited

U.S. PATENT DOCUMENTS

| | | | |
|---|---|---|---|
| 2,726,865 | 12/1955 | Backhouse | 271/231 |
| 3,916,790 | 11/1975 | Alix | 101/232 |
| 3,992,993 | 11/1976 | Kuhn et al. | 101/232 |
| 4,018,161 | 4/1977 | Johne et al. | 101/231 |
| 4,024,814 | 5/1977 | Becker | 101/410 |
| 4,029,009 | 6/1977 | Kuhn et al. | 101/409 |
| 4,127,265 | 11/1978 | Wirz et al. | 271/276 X |
| 4,241,659 | 12/1980 | Fischer | 101/232 |
| 4,343,241 | 8/1982 | Rudolph et al. | 271/276 |
| 4,378,734 | 4/1983 | Wirz | 101/410 |

FOREIGN PATENT DOCUMENTS

| | | | |
|---|---|---|---|
| 670765 | 9/1963 | Canada | 271/276 |
| 54703 | 3/1967 | German Democratic Rep. | . |
| 59102 | 12/1967 | German Democratic Rep. | . |
| 110452 | 12/1974 | German Democratic Rep. | . |
| 376277 | 5/1973 | U.S.S.R. | 101/232 |
| 1268180 | 3/1972 | United Kingdom | 101/232 |

*Primary Examiner*—Eugene H. Eickholt
*Attorney, Agent, or Firm*—Michael J. Striker

[57] ABSTRACT

A suction system is arranged in a sheet guiding cylinder of a printing machine which is switchable from the first form mode to the printing on both sides of the sheet which is turned over by the suction system around its rear edge. The suction system includes an arrangement for automatically controlling suction air for operating a suction head which is movable in a sucker body of the suction system.

1 Claim, 3 Drawing Sheets

SUCTION SYSTEM FOR SHEET GUIDING CYLINDERS IN PRINTING MACHINES

BACKGROUND OF THE INVENTION

The present invention relates to sheet-fed printing machines in general, and more particularly to a suction system for sheet guiding cylinders of a printing machine which is switchable for printing in one of two operational modes such as printing on one side of the sheet only, which is the first form mode, or printing on both sides of the sheet when the sheet is first printed on one side and thereafter is turned around its rear edge by means of the suction system and printed on its back side.

Suction systems of the type under consideration have been known. The suction system of this type disclosed in DD-PS No. 54,703 is arranged on the sheet guiding cylinder positioned between two printing cylinders. The sheet turning is carried out such that during the passing of the tangential point, that is the point of contact between two cylinders, the rear edge of the sheet to be turned is sucked by the suction system and the sheet is transported to the gripper system. The disadvantage of this otherwise satisfactory suction system resides in that the time for sucking the sheet to be turned over is very short. The suction system must be loaded with underpressure in a very short period of time and thus a precise control and high technical expenses connected therewith are required. Furthermore the increase in the machine output is also limited by short suction time.

The suction system disclosed in DD-PS No. 110,452 is already set on the leading edge of the sheet before the tangent point between the sheet guiding cylinder and the pre-arranged printing cylinder. The time available in this known design for suction the sheet is also too short because the sucker system must be moved over a trochoid path and, immediately after being set on the sheet trust, be controlled in the path from the printing cylinder to the sheet guiding cylinder. This type of control requires an extremely complex drive.

A pneumatic loading of the suction system has been disclosed in DD-PS No. 59102. The suckers in this publication are secured to a hollow swinging shaft on which air distributors are mounted. Air conduits lead from the air distributors to the hollow shaft of the sheet guiding cylinder. Each sucker is cyclically pneumatically loaded by a control shaft arranged adjacent to the sucker; this control shaft is mounted between the swinging shaft and the suction mouth.

The disadvantage of this air control device resides in that the underpressure which is necessary for the operation of the plurality of pneumatically loaded systems can be built up rather slow. Thereby register error can occur, which would negatively affect the printing output.

SUMMARY OF THE INVENTION

It is an object of the present invention to provide an improved suction system for sucking sheets in a sheet guiding cylinder of a printing machine, which would ensure a register-correct turning of sheets being printed on.

It is another object of the invention to provide a suction system for a sheet guiding cylinder of a printing machine, which would provide a long suction track during the engaging a rear edge of the sheet being turned and which would insure an automatic control of the suction air.

These and other objects of the invention are attained by a suction system arranged in a rotary sheet guiding cylinder of a printing machine which is switchable for selecting one of two operational modes such as printing on one side of the sheet only or printing on both sides of the sheet when the sheet is first printed on one side and thereupon is turned over around a rear edge thereof and printed on a back of the sheet, the suction system turning said sheet over at said rear edge and comprising a suction head, and means supplying suction air to said suction head, said suction head being movable, and means to automatically control suction air for sucking sheets being printed, said control means being arranged in the sheet guiding cylinder.

The suction system may further include a sucker body, said control means including a control element, said suction head with said control element being movably arranged in said sucker body.

The control element may have a suction channel which opens into said suction head, said sucker body having a pneumatically loadable suction passage, said suction channel selectively overlapping said suction passage upon the movement of said control element.

The suction system may further include a control piston positioned in a cylindrical bore formed in said sucker body, and a compression spring loading said control element which is rigidly connected to said control piston.

The suction system may further include passage means for pneumatically loading said cylindrical bore with suction air.

The control element with said suction head may be swingable in said sucker body.

The major advantage of the suction system according to the present invention resides in that the suction system is mounted in the sheet guiding cylinder before the tangent point between the sheet guiding cylinder and the printing cylinder. Thereby the time available for sucking a sheet being printed on is expanded so that a reliable suction is ensured.

The automatic suction air control of the suction system during the suction process is warranted, and the time of suction is constant which is advantageous for the adjustment of the system.

For the processing of materials of various thicknesses, the adjustment is no longer necessary and the processing of materials of different properties presents no difficulties.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
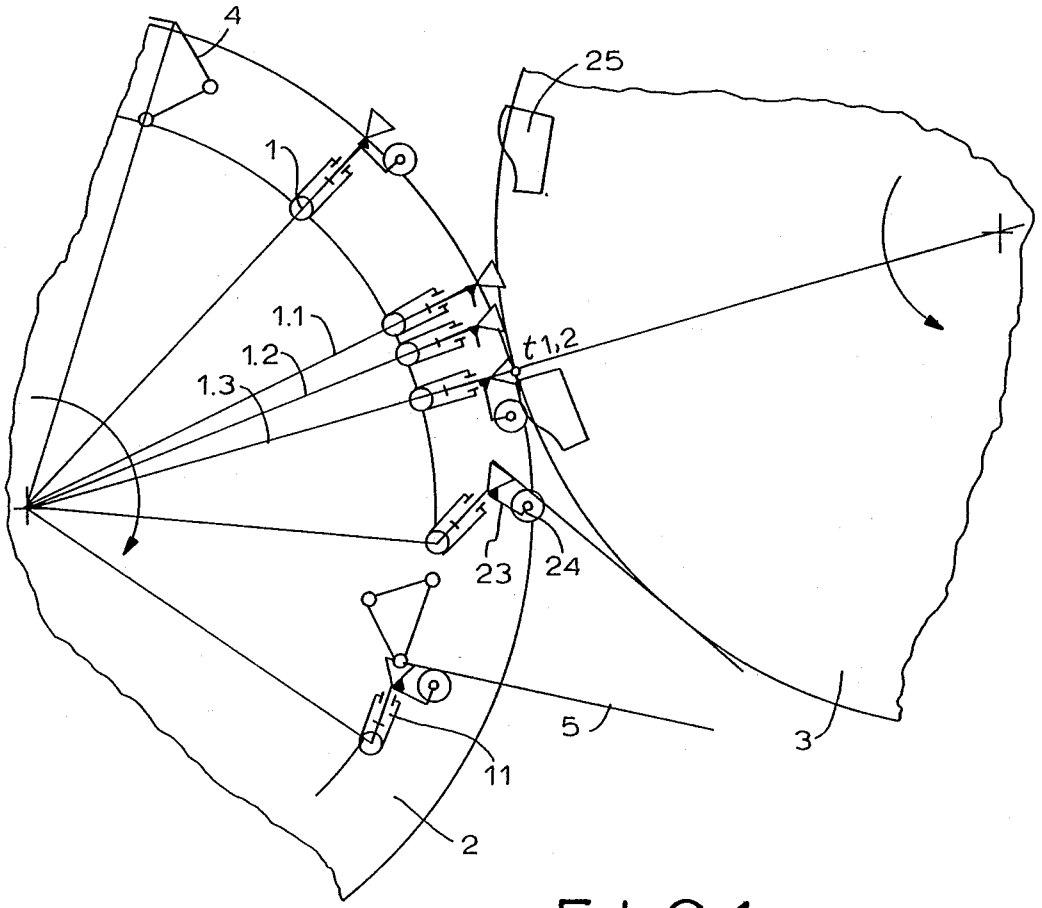
FIG. 1 is a schematic side view of the sheet-transfer cylinder with a suction system in the operation phase.

FIG. 1 schematically illustrates an operation phase of a suction system 1 of a rotary sheet guiding cylinder 2. A rotary printing cylinder is denoted by reference numeral 3 and a sheet gripping system is designated by reference numeral 4. A sheet to be turned is denoted by reference numeral 5. The principle of the sheet turning in accordance with the principle of turning the sheet around its rear edge to print on its back after it has been first printed on one side, by means of the suction and gripping system 1, 4 is known and has been disclosed, for example in DD-PS No. 54,703.

The suction system 1 is shown before and after the sheet transfer, in the initial position 1.1, intermediate position 1.2 and in the phase of sheet guidance 1.3.

Figure 2:
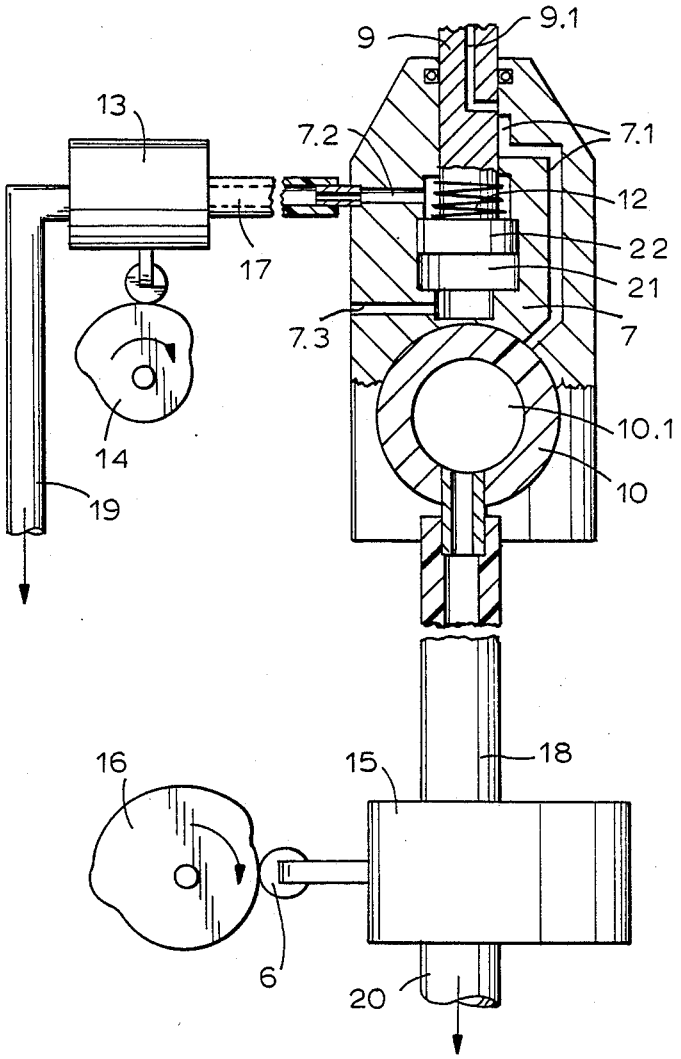
FIG. 2 is a side view of the suction system in the initial position.

With reference to FIG. 2 it will be seen that the suction system 1, shown in this figure in the initial position 1.1 includes a suction head 8, a control element 9 and a sucker 7. A suction passage 9.1 which opens into the suction head 8 is provided in the control element 9. A suction passage 7.1 provided in the suction member 7 corresponds to the suction or drawing-off passage 9.1. The suction passage 7.1 opens into a swinging shaft 10 which has a hollow space 10.1. The swinging shaft 10 supports the suction member or sucker 7. The swinging or oscillating shaft 10 is mounted over the width of the sheet guiding cylinder in the conventional manner.

The swinging shaft 10 is connected via a suction conduit 18 to a control valve 15 which has a push rod 6 engaged with a control cam 16. The control valve 15 is connected via a connection line 20 with a non-shown vacuum generator.

The control element 9 is displaceable in the suction member 7, whereby a compression spring 12 is provided in a cylindrical bore 21 of the sucker body 7. Spring 12 acts against the control element 9 which is rigidly connected to a control piston 22. A venting channel 7.3 opens into the cylindrical bore 21.

Into a control conduit 17 opens a control passage 7.2 provided between the control element 9 and the control piston 22. Control conduit 17 is connected with a second control valve 13 provided with a push rod 6 which in turn cooperates with a second control cam 14. The second control valve 13 is also pneumatically loaded with vacuum via a second connection line 19.

The operation of the suction system according to the invention is as follows:

In the two-operation mode-fashion in which one side of the sheet is first printed and then the sheet is turned over to allow for its back side to be printed on, the sheet to be printed is engaged at its trailing edge before the tangential point between the printing cylinder 3 and the sheet guiding cylinder 2 by the suction system 1 and guided at the peripheral surface of the sheet guiding cylinder 2, then transmitted by the suction system 1 to the gripper system 4 and is further guided through the printing machine for further processing. The suction system 1 is controlled and pneumatically loaded.

Before reaching the point of contact, e.g. tangential point between the printing cylinder 30 and the sheet-guiding cylinder 2 the suction system 1 is moved to the initial position 1.1. For this purpose, the second control valve 13 is opened by the second control cam 14 and underpressure is generated via the control conduit 17 and control passage 7.2 in the cylindrical bore 21. The underpressure causes the control element 9 with the suction head 8 to move to the outer initial position shown in FIG. 2 against the force of the compression spring 12 and the atmospheric pressure action via the venting channel 7.3 on the control piston 22. During the rotation of the sheet-guiding cylinder 2 the suction head 8 is set on the peripheral surface of the printing cylinder 3 (as shown in FIG. 1).

Figure 3:
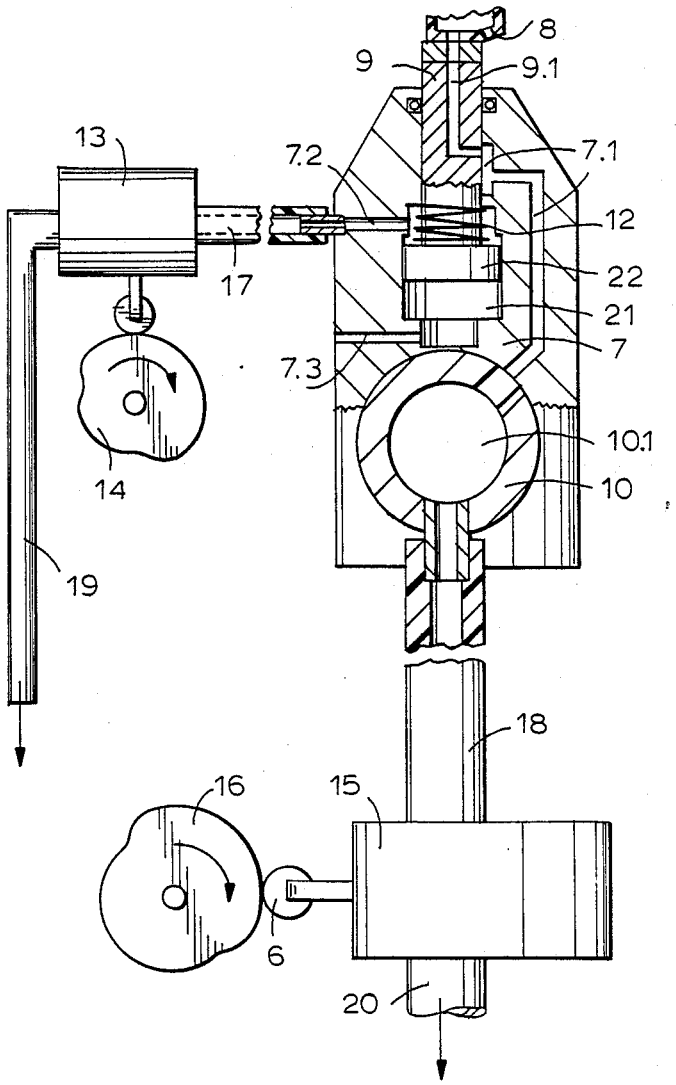
FIG. 3 is a side view of the suction system in the intermediate position for sheet transfer.

The suction channel 7.1 pneumatically loaded through the control cam 16, control valve 15, suction conduit 18 and swinging shaft 10 is closed by the control element 9. Upon further rotation of the sheet guiding cylinder 3, the suction head 8 with the control element 9 slides, with the further generation of underpressure in the cylindrical bore 21, in the sucker body 7 in the direction of the swinging shaft 10. Due to this movement the suction passage 9.1 with the suction passage 7.1 which is terminated in the suction member 7 overlap each other so that the suction head 8 is pneumatically loaded via the passage 9.1 and the sheet 5 can be sucked in the intermediate position of the suction system as shown in FIG. 3.

Figure 4:
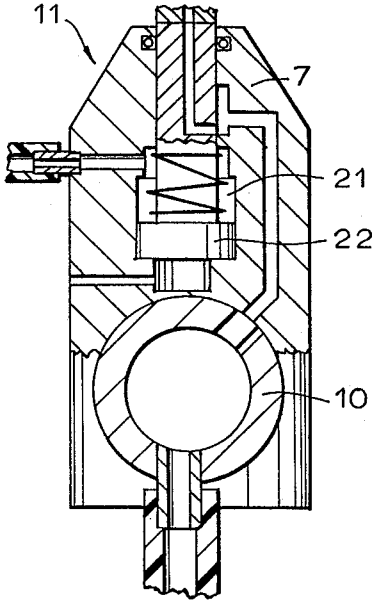
FIG. 4 is a side view of the suction system in the position during the sheet guidance for a sheet turning.

In the phase of the sheet guidance 1.3 illustrated in FIG. 4, the underpressure in the cylindrical bore 21 is switched off. The suction head 8 is further pneumatically loaded. By the non-shown drive, the suction system 1 and the gripping system 4 are controlled in respect to each other and the sheet 5 is transferred to the gripping system in the known manner. In this phase of operation the control valve 15 controlled by the control cam 16 and the underpressure in the suction head 8 are shut off. The suction head 8 is automatically held in the lower position 1.3 by the force of the compression spring 12 when the control valve 13 is shut off so that the swing-out process of the gripper-suction system 4, 1 as well as the rotation of the suction system 1 is not hindered by the cylinder, for example printing cylinder which is positioned after the sheet guiding cylinder 2.

In the operation mode, which is the so-called first form mode, the suction head 8 is maintained in the position 1.3 by spring 12 due to the switching off the underpressure generator or by adjusting of the control cam 14.

The suction head can, at the predetermined rotation angle of the sheet guiding cylinder, also be controlled in the initial position 1.1 by the actuation of the control valve 13 via the control cam 14 before the point of contact $t_12$. Thereby the pressure fluctuations in the pneumatic system of the sheet guiding cylinder 2 can be reduced and not negatively affect the suction of the sheet 5 by the suction head 8 in the position 1.2.

The utilization of the above described automatic air control of the suction system 1 is possible not only with the sheet guiding cylinders 2 of small diameter but also with the cylinders having double-size diameters.

The suction head 8 can be supported to swing relative to the suction member 7 (not shown).

It will be understood that each of the elements described above, or two or more together, may also find a useful application in other types of suction systems for sheet guiding cylinders of printing machines differing from the types described above.

While the invention has been illustrated and described as embodied in a suction system for sheet guiding cylinders of printing machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a suction system positioned on a rotary sheet guiding cylinder of a printing machine provided with means to effect printing on one side of the sheet only or printing on both sides of the sheet when the sheet is first printed on one side and thereupon is turned over around a rear edge thereof and printed on a back of the sheet, said guiding cylinder having a sheet-supporting peripheral surface receiving a sheet being turned, the suction system being pneumatically operated to turn said sheet over at said rear edge and comprising a suction head, and means supplying suction air to said suction head, said suction system being pivotable relative to said guiding cylinder; a sucker body; a control element, said suction head being rigidly connected to said control element; said sucker body defining a cylindrical bore; said sucker body including a suction channel which is connected to said suction air supplying means, said control element including a suction passage adapted to communicate with said suction channel; a control piston, said control element being rigidly connected to said piston and being displaceable therewith in said cylindrical bore upon application of suction by said sucker air supplying means; and a compression spring positioned in said bore and biasing said control element, said suction body further including a control passage which opens into said cylindrical bore, said suction passage (9.1) in said control element selectively overlapping said suction channel (7.1) upon the movement of said control element.

* * * * *